US006158479A

United States Patent [19]

Lindblom

[11] Patent Number: 6,158,479

[45] Date of Patent: Dec. 12, 2000

[54] ARRANGEMENT FOR SHOOTING AND ACCELERATING A SHUTTLE IN A WEAVING MACHINE

[75] Inventor: Bo Lindblom, Osby, Sweden

[73] Assignee: Texo AB, Almhult, Sweden

[21] Appl. No.: 09/258,202

[22] Filed: Feb. 26, 1999

[30] Foreign Application Priority Data

Mar. 24, 1998 [SE] Sweden ..... 9800986

[51] Int. Cl.[7] ..... D03D 47/30; D03D 49/24; D03D 49/42

[52] U.S. Cl. ..... 139/435.1; 139/435.5; 139/438

[58] Field of Search ..... 139/435.1, 435.5, 139/438

[56] References Cited

U.S. PATENT DOCUMENTS

| | | | |
|---|---|---|---|
| 2,488,192 | 9/1949 | Hindle . | |
| 3,395,737 | 8/1968 | Wueger . | |
| 3,412,763 | 11/1968 | Wueger . | |
| 3,461,919 | 8/1969 | Wueger . | |
| 3,831,640 | 8/1974 | Wueger . | |
| 4,046,174 | 9/1977 | Wueger . | |
| 4,194,539 | 3/1980 | Griffith . | |
| 4,245,677 | 1/1981 | Suzuki . | |
| 4,304,269 | 12/1981 | Suzuki et al. . | |
| 4,401,139 | 8/1983 | Koriyama et al. . | |
| 4,442,871 | 4/1984 | Suzuki et al. . | |
| 4,448,222 | 5/1984 | Arakawa . | |
| 5,067,527 | 11/1991 | De Jager | 139/435.2 |
| 5,183,084 | 2/1993 | Moeneclaey | 139/449 |

*Primary Examiner*—Andy Falik
*Attorney, Agent, or Firm*—Pollock, Vande Sande & Amernick, PLLC

[57] ABSTRACT

Shooting and guide members for a shuttle are arranged in a weaving machine. The shooting member comprises an air pressure source which supplies compressed air to one or more acceleration nozzles. The acceleration nozzle or nozzles are arranged to accommodate the shuttle at the time of shooting and, depending on the compressed-air supply, generating one or more air jets. The shuttle is made with surfaces which can be exposed to the air jets. The nozzle and guide members are arranged so as to guide the shuttle at least at the beginning of its shooting trajectory, when the air jet of the acceleration nozzle are brought into effect.

19 Claims, 5 Drawing Sheets

ARRANGEMENT FOR SHOOTING AND ACCELERATING A SHUTTLE IN A WEAVING MACHINE

TECHNICAL FIELD

The present invention relates to an arrangement for a shuttle in a weaving machine from the first side of the weaving machine to the second side of the weaving machine. In this connection, use is made of shooting members arranged on the first side. The invention also relates to an assembly with acceleration nozzles. Furthermore, the invention relates to a which is shootable from the first side of the weaving machine across to its second side.

BACKGROUND OF THE INVENTION

There are today a great many shooting devices for moving the respective weaving machine shuttle from one side of the weaving machine to the other side. The invention is primarily intended to be used on weaving machines for wire product manufacture. Such weaving machines may have widths of 8–30 meters. In this connection, reference is made to the TEXO 300 and TEXO 400 weaving machines sold on the market by TEXO AB. In these weaving machines, use is made of, among other things hydraulically operating striking units for the shuttle shots.

Hydraulically operating striking units carry out shooting of, to a great extent free-flying shuttles. In the case of increased weaving machine speeds, the shooting speeds are increased and the shuttles that frequently come into contact with the warp threads during shooting risk causing damage to them on account of the high speeds. The rapidly flying shuttles may give rise to, among other things, undesirable heat action on the warp threads. There is therefore a requirement for shooting and shuttle guiding arrangements allowing to retain high shooting speeds but at the same time allowing for shooting and shuttle guiding without the disadvantages discussed above. The invention aims to solve this problem.

In connection with weaving machines, there is a requirement for decreasing the amount of hydraulic equipment for the purpose of achieving a desirable reduction in the weight of the weaving machine. It is also desirable to reduce the noise level in the weaving-machine hall. The invention aims to solve this problem also.

There is also desire slimplify to simplify the shooting arrangements for shuttles in weaving machines of this type. The invention also solves this problem.

THE SOLUTION

It is considered to be characteristic of an arrangement of the type indicated in the introduction that the shooting members comprise an air-pressure source which supplies compressed air to one or more acceleration nozzles, and that the acceleration nozzle or acceleration nozzles is/are arranged to accommodate the shuttle at the time of shooting and, depending on the compressed-air supply, generate one or more air jets. In this connection, the shuttle is made with surfaces which can be exposed to the air jet(s). The nozzle(s) and guide members are arranged to guide the shuttle at least at the beginning of its shooting trajectory when the air jet(s) is/are brought into effect.

Each acceleration nozzle is provided with a number of outlet orifices for air, arranged one following another in the longitudinal directions of the nozzle and the shuttle, for forming a number of air jets corresponding to the number of orifices. Those surfaces on the shuttle which can be exposed to the air jets comprise projecting fin-like portions which located on the shuttle and arranged one after another in the longitudinal direction of the shuttle. The number of fin-like portions can correspond essentially to the number of orifices and, in the starting position of the shuttle in the nozzle, each surface on each fin-like portion is located opposite its air jet orifice in the acceleration nozzle. The surfaces on the portions located at the rear can therefore successively pass the nozzle orifices and are in this way subjected to their outgoing air jets during shooting. Each nozzle can comprise at each stage or level a number of orifices or openings for air jets.

Those surfaces on the shuttle which can be exposed to air jets also comprise internal surfaces in the shuttle. Internal surfaces can also be exposed to one or more air jets via a longitudinal slot arranged in the shuttle and/or via a backwardly directed opening in the shuttle. The internal surfaces can be arranged to follow one another in the longitudinal direction of the shuttle. As the shuttle moves forward in the nozzle, the inner surfaces are successively exposed to orifices arranged following one another on the acceleration nozzle or equivalent.

The guide members comprise one or more elements arranged following one another in the direction of the shooting trajectory and support guide members which interact with the shuttle. These interacting members extend into the interior of the shuttle via a slot which is located on the shuttle and passes through the shuttle wall. Each member which can interact with the shuttle has an essentially circular shape, seen in the longitudinal direction of the shuttle. The shuttle is designed with a recess which extends in the longitudinal direction of the shuttle and has a cross section which has a circularity which corresponds essentially to the circularity of the member which can interact with the shuttle. In a preferred embodiment, pin-shaped elements support at their own ends the members which can interact with the shuttle. The pin-shaped elements can be arranged following one another along the entire width of the weaving machine. The pin-shaped elements are arranged with a spacing which results in the shuttle, over its entire shot, interacting simultaneously with at least three or more members which can interact with the shuttle. The pin-shaped elements can be arranged so as to allow warp threads to pass between them. The pin-shaped elements can also be arranged on the reed assembly and follow the latter in its beating-up movements towards the established beating-up edge without interfering with the beating-up function as such.

A shuttle according to the invention is arranged with surfaces which can be exposed to one or more air jets. The shuttle can have a guide recess which extends in the longitudinal direction of the shuttle and is open outwardly via a through-slot in the shuttle wall. The shuttle is arranged so that, during its shot from the first side to the second side of the weaving machine, it runs on pin-shaped elements arranged following one another in the width direction of the weaving machine and, as the shuttle passes, each extend in via the through-slot and bear at their end a guide member against which the shuttle is guided via its guide recess.

An assembly with acceleration nozzle(s) is arranged to perform a shooting function for a shuttle forming part of a weaving machine. The assembly comprises one or more acceleration nozzles which comprise openings, arranged in the longitudinal direction of the assembly, for bringing air jets into effect against outer and/or inner exposable surfaces arranged on the shuttle. Each nozzle and, if appropriate, the shuttle can be connected to an air pressure source.

By means of what has been proposed above, pneumatic shooting arrangements can be used together with guiding arrangements, according to the object of the invention, for the shuttle over its entire shooting trajectory. The environment around the weaving machine can be improved. As described above, the guide members can consist of pin-shaped elements, between which the warp threads run. The pin-shaped elements can be arranged on the reed assembly and follow the latter in its movements without interfering with the interaction of the reed with the beating-up edge in the weaving machine. The noise level in the weaving hall can be reduced considerably and the technical construction and the associated costs can be considerably simplified and reduced respectively. With the acceleration nozzle assembly, an effective acceleration function can be achieved, which ensures high shooting speeds. The members guiding the shuttle can also have designs, like the recess in the shuttle, which guarantee a rapid transport movement of the shuttle from one side of the weaving machine to the other side.

BRIEF DESCRIPTION OF THE DRAWINGS

The presently proposed embodiment which has the significant features of the new arrangement and the new shuttle is described below with simultaneous reference to the appended drawings, in which.

DETAILED DESCRIPTION OF A PREFERRED EMBODIMENT

Figure 1:
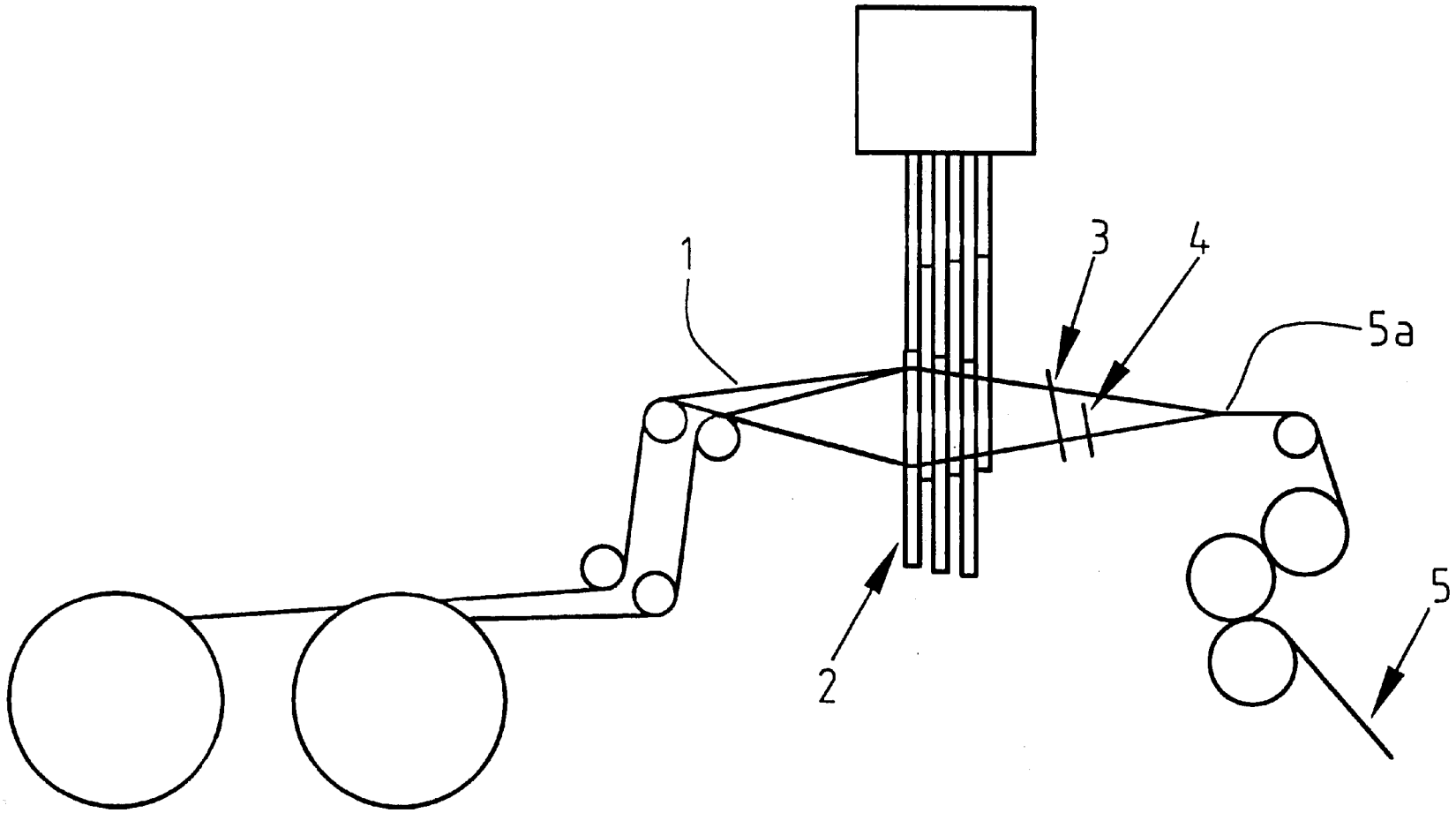
FIG. 1 shows in principle and from the side the construction of a current weaving machine, with warp threads, heald shafts, reed and guide members.

FIG. 1 shows, in principle a weaving machine for weaving wire products. As the machine is well-known, it is not described in greater detail here but only those parts which are affected by the present invention are indicated here. In this connection, the warp threads are indicated by 1, the heald shaft assembly by 2 and the reed of the weaving machine by 3. A guide pin assembly, which is new in connection with the weaving machine, has been indicated by 4. The woven material or the wire product being formed is indicated by 5. The beating-up edge of the woven material is indicated by 5*a*. A characteristic feature is that the guide pin assembly 4 follows the reed movements towards and away from the beating-up edge 5*a* in the woven material.

Figure 2:
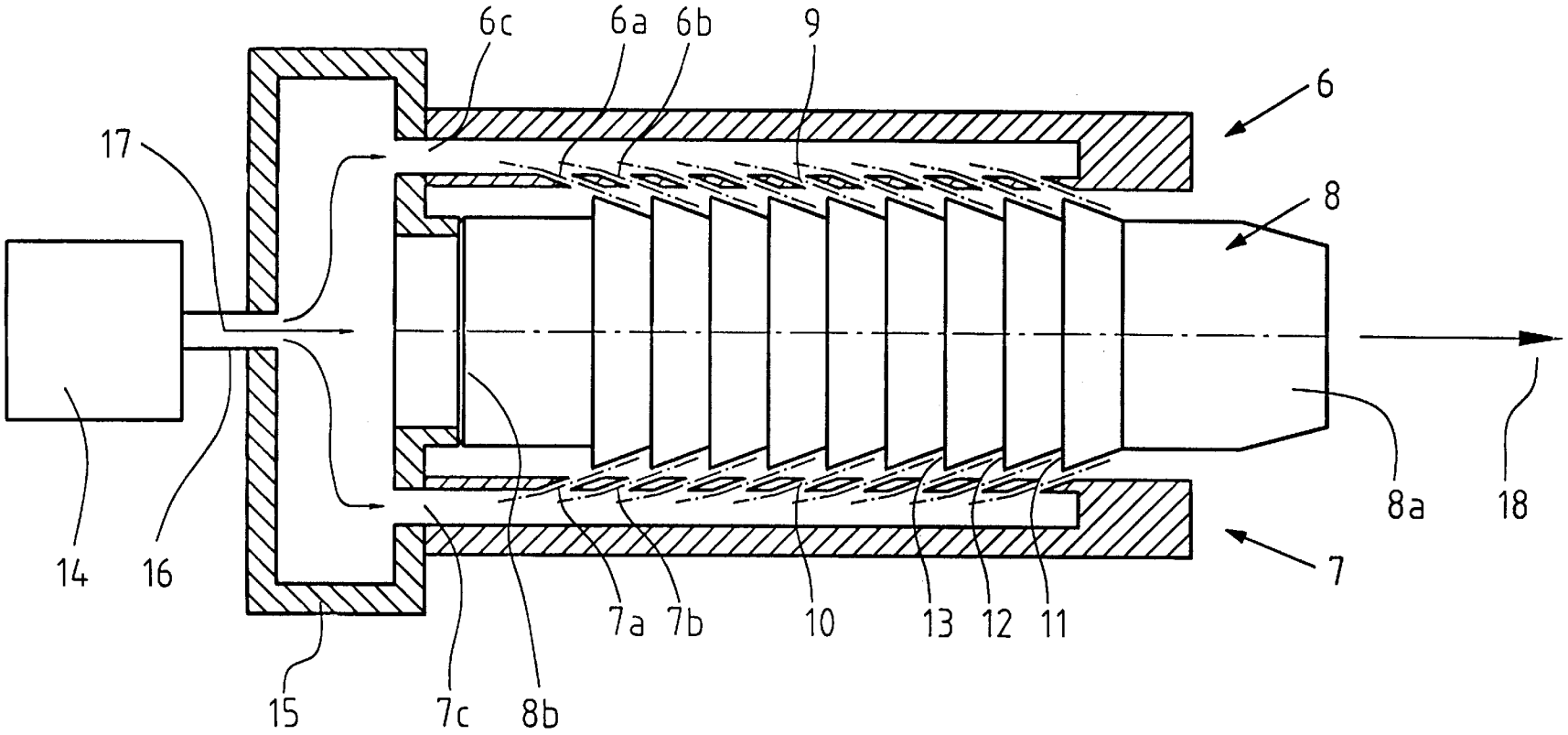
FIG. 2 shows, in a horizontal view, an acceleration nozzle assembly and a shuttle arranged therein and also pressure generating equipment and connection members that can be connected to the assembly and the shuttle.

FIG. 2 shows two acceleration nozzles 6 and 7 and a shuttle 8. The nozzles are arranged on either side of the shuttle and can follow the shape of the latter in full or in part. Each nozzle is provided with a number of outlet holes arranged following one another for air jets. Two holes of each nozzle are indicated by 6*a*, 6*b* and 7*a*, 7*b* respectively. The outlet holes are arranged following one another along the shuttle and the longitudinal axis 8*a* of the nozzle assembly. An air jet from each nozzle is symbolized by 9 and 10 respectively. The shuttle is made with a number of fin-like portions, three of which are shown as 11, 12 and 13. In the starting position according to FIG. 2, each fin-like portion is located opposite one or more air jet openings in the respective nozzle. The fin-like portions have external surfaces which can be exposed to the air jet openings and thus to the air jets.

A compressed-air source is shown by 14 and the connection member to the nozzles and the shuttle is shown by 15. As described below, the shuttle is provided with a backwardly directed opening 8*b*. The nozzles 6 and 7 are also provided with backwardly directed openings 6*c* and 7*c*. The connection member is connected to the openings. The pressure source 14 is connected to the connection member via a connecting line 16. Air flows generated by the pressure source are indicated by arrows 17. The air from the pressure source is fed into the nozzles and into the shuttle via their openings. When the compressed air is brought into effect, the shuttle moves out of the nozzle assembly in the direction of the arrow 18. The surfaces on the fin-like portions are then exposed to the openings/the air jets in the acceleration nozzles depending on their positions on the shuttle. The rear surfaces will then be exposed successively to the air jets as the shuttle leaves the nozzle assembly. The front surfaces are exposed to fewer openings/air jets. The shuttle weighs roughly 2 kg. The pressure member generates pressure of roughly 10 MPa, which produces roughly 1 MPa pressure in each air jet. The air jet through the rear opening 8*b* of the shuttle is of the order of 5 MPa. The openings may be of the same size or vary along the longitudinal directions of the nozzles, in which case different air jet pressures are obtained along the longitudinal directions of the nozzles. One or more nozzles may be used. In the event that one nozzle is used, it can be of essentially circular design and surround the shuttle. One or more pressure sources may also be used, as well as one or more connection members 1, for example one connection member for each opening 6*c*, 7*c*, 8*b*.

Figure 3:
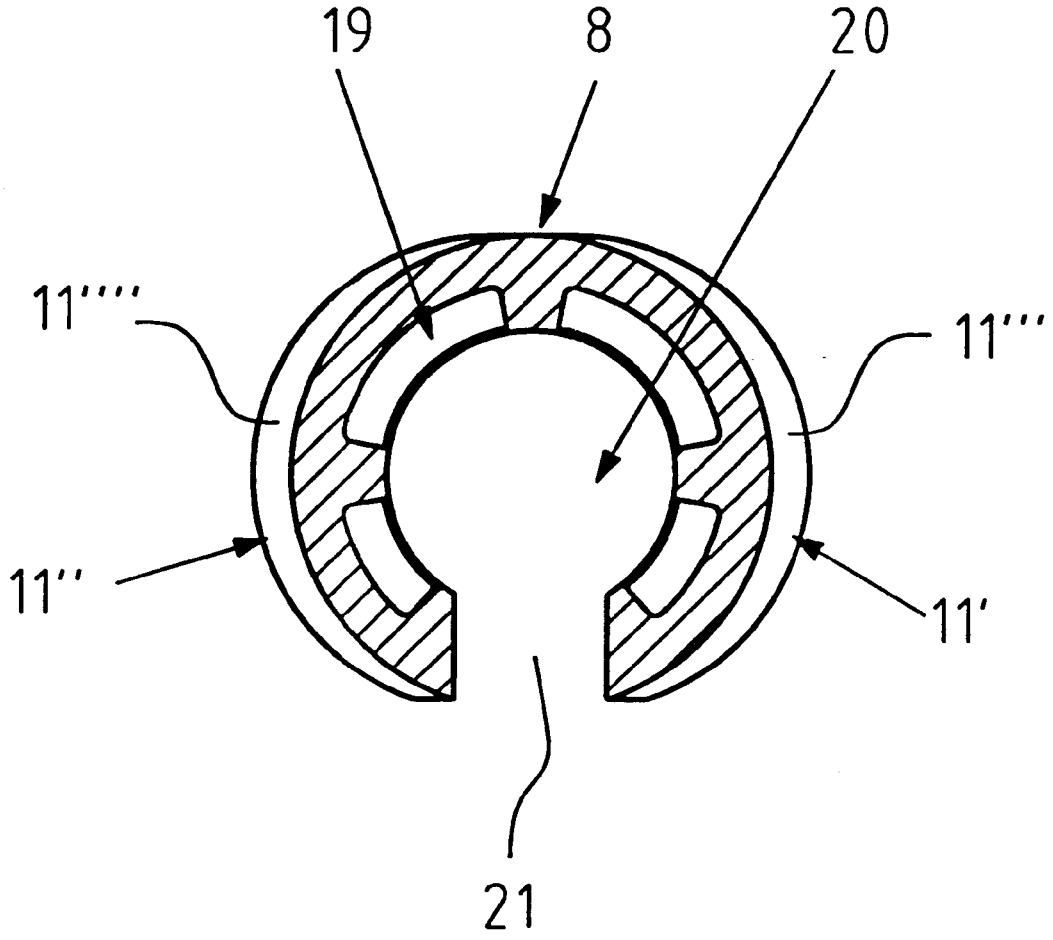
FIG. 3 shows, in cross section, and from the rear parts of the construction of the shuttle.

FIG. 3 shows the shuttle from the rear. The fin-like portions 11', 11" have the surfaces 11'" and 11" respectively, which can be exposed to the air jets as described above. The shuttle is also provided with internal surfaces/fin-like portions which can be exposed to air jets. The surfaces may extend around all or part of the relevant circumference on the shuttle. In the present case, four inner surfaces distributed along the periphery are arranged in each relevant cross section. The inner surfaces 19 may also be arranged in a row following one another as is the case with the external surfaces. The shuttle is provided with a recess 20 which extends along its entire longitudinal extent (that is to say at right angles to the plane of the paper according to FIG. 3) and is open radially outwardly via a slot 21 which passes through a shuttle wall and also extends essentially along the entire length of the shuttle. Supply from the air-jet(s) may take place in an alternative or supplementary manner via this slot to the internal surfaces 19. The shuttle has an essentially circular or oval outer circumference.

Figure 4:
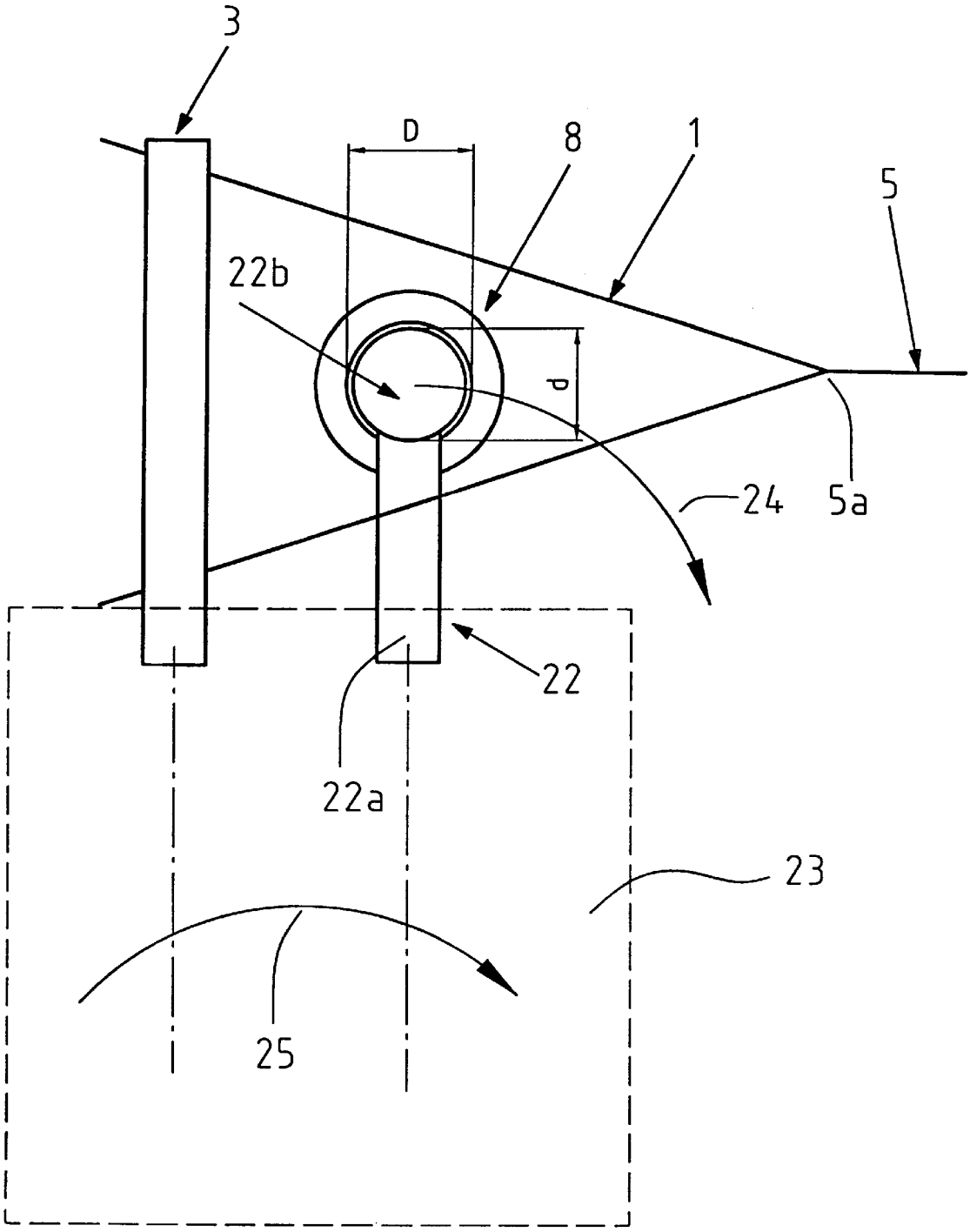
FIG. 4 shows, from the side, the interaction between the shuttle and the guide members in association with the warp threads and reed of the weaving machine.

FIG. 4 shows a guide member 22 which, in the prefered embodiment, has a pin-shaped element 22*a* and a member 22*b* which guides the shuttle. The pin-shaped element extends into the shuttle via the slot 21 (see FIG. 3). The recess 20 is essentially circular and the member 22*b* is, in the view shown in the figure, made with a circularity which corresponds essentially to the circularity of the recess 20. The diameter D of the recess slightly exceeds the diameter d of the member 22*b*, preferably by between 2–6 mm, particularly advantageously in the range of 3–5 mm. The recess and, respectively, the member 22*b* may have a shape other than circular. A number of guide members according to 22 are arranged along the entire width of the weaving machine. All the pin-shaped members are arranged in the reed assembly, the rotatability of which is shown by 23 in the figure. The movement of the member 22 follows the movement of the reed. The member has such a position in relation to the beating-up edge 5*a* that it does not knock into the latter and interfere with the beating-up function. The guide member moves below the beating-up edge on a path 24 according to the embodiment in FIG. 4. The common rocking movement of the reed and the guide member is shown by 25.

Figure 5:
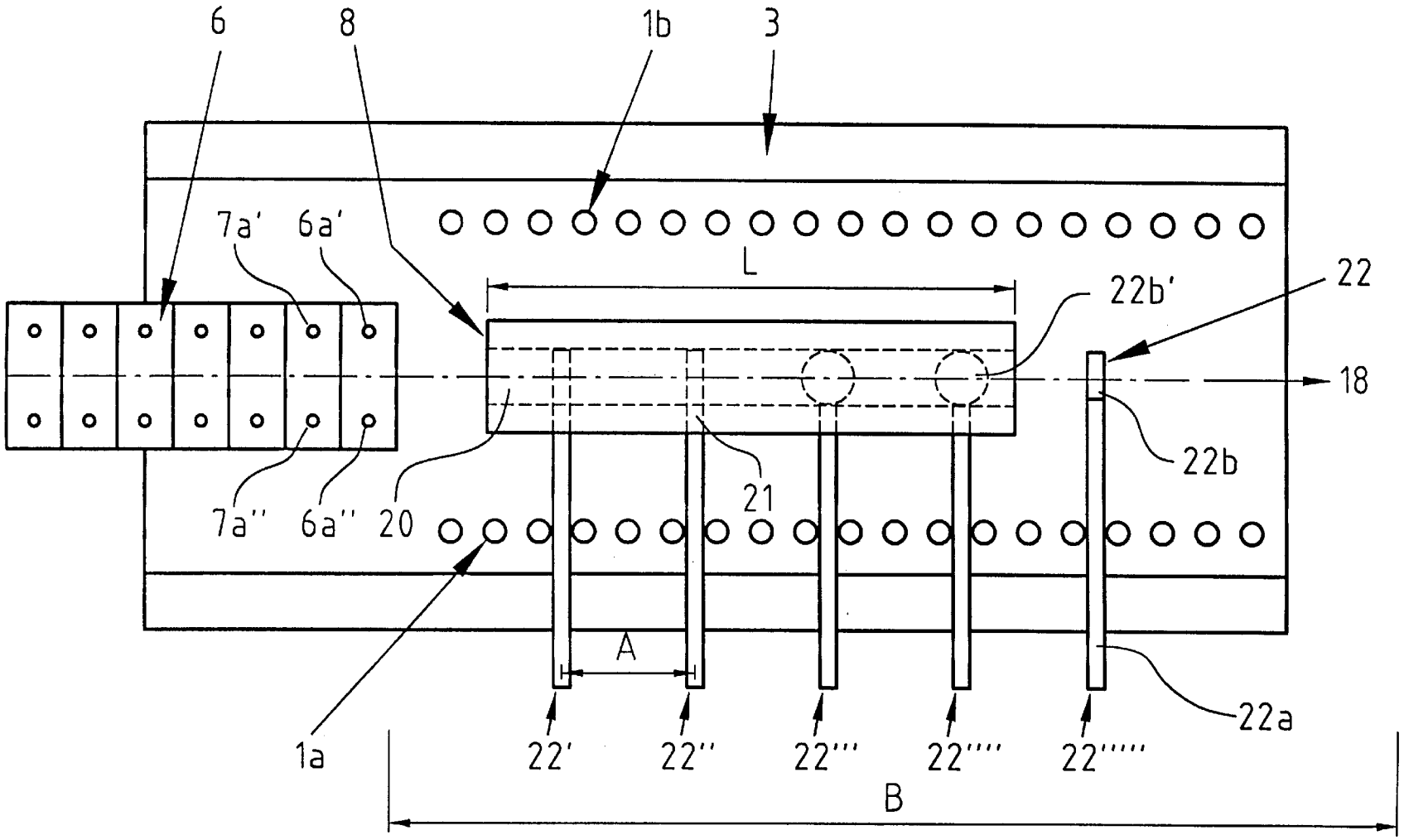
FIG. 5 shows parts of the weaving machine from the front when the shuttle has left the acceleration nozzles and interacts with the guide members during its transport to the other side of the machine.

FIG. 5 shows the guide member assembly with a number of guide members 22'–22"" arranged following one another over the entire width direction B of the weaving machine. The pin-shaped elements are in this connection arranged in such a manner that the warp threads 1*a*, 1*b* can run between them. Each acceleration nozzle, for example the nozzle 6, may have a number of outlet openings 6*a*', 6*a*" and 7*a*', 7*a*" respectively at each level or in each stage 6*a*, 6*b* and 7*a*, 7*b* respectively (see FIG. 2). The shuttle runs on the guide members 22'–22"" and a distance A between the pins is in this connection selected in relation to the length L of the shuttle so that, in every longitudinal displacement position in its shooting trajectory 18, the shuttle is supported by at least 3–4 guide members. The figure shows that the member 22*b*, 22*b*' may be designed as a circular disc 22*b* or as a sphere 22*b*'.

The invention is not limited to the embodiment shown above by way of example but can be modified within the scope of the claims below and the inventive idea.

I claim:

1. Combination of a shuttle and apparatus for accelerating the shuttle from a first side to a second side of a weaving machine, comprising:

an air pressure source;

acceleration nozzles receiving compressed air from the air pressure source, the acceleration nozzles generating at least one air jet and being arranged to receive the shuttle; and guide members arranged to guide the shuttle at least at a beginning of its movement from the first side to the second side, the shuttle having a number of surfaces exposed to the air jets.

2. The arrangement according to claim 1, wherein each acceleration nozzle is provided with a number of outlet orifices arranged one another in a longitudinal directions of the nozzle and the shuttle, the outlet orifices forming a number of air jets corresponding to the number of outlet orifices, and the surfaces on the shuttle exposed to the air jets are projecting fin-like portions arranged one following another in the longitudinal direction of the shuttle.

3. The arrangement according to claim 2, wherein the number of fin-like portions corresponds to the number of outlet orifices and, in a starting position of the shuttle in the nozzle, each surface on each fin-like portion is located opposite a respective outlet orifice in the acceleration nozzle.

4. The arrangement according to claim 1, wherein the shuttle further comprises a backwardly directed opening arranged in the shuttle the opening exposing internal structures in the shuttle which may be exposed to the air jets.

5. The arrangement according to claim 4, wherein the internal structures are arranged following one another in the longitudinal direction of the shuttle, so that, as the shuttle moves forward in the nozzle assembly, the internal structures are successively exposed to the outlet orifices arranged following one another on the acceleration nozzle.

6. The arrangement according to claim 1, wherein the guide members comprise one or more guide elements arranged following each another in the direction of a shooting trajectory and support member arranged thereon for interaction with the shuttle.

7. The arrangement as claimed in claim 6, wherein said members interacting with the shuttle extend into the interior of the shuttle via a slot (21) which is located on the shuttle and passes through the shuttle wall.

8. The arrangement according to claim 7, wherein each support member which can interact with the shuttle has an essentially circular shape, seen in the longitudinal direction of the shuttle, and the shuttle (8) defines a recess which extends in the longitudinal direction of the shuttle and has a cross section which has a circularity which corresponds to and slightly exceeds the circularity of the support member which can interact with the shuttle.

9. The arrangement according to claim 6, wherein the guide elements further comprise pin-shaped elements supporting at their one end the support members which interact with the shuttle, the pin-shaped members are arranged following one another along the entire width of the weaving machine, and the pin-shaped elements are arranged with a spacing therebetween which results in the shuttle, over the major part of its entire shooting trajectory, engaging with at least three of said support members.

10. The arrangement according to claim 9, wherein said pin-shaped elements are arranged so as to allow warp threads to pass, and the pin-shaped elements are arranged on a reed assembly and follow the reed assembly in its beating-up movements towards an established beating-up edge without interfering with the beating-up function.

11. A combination of a shuttle and apparatus for guiding the shuttle in a weaving machine, from a first side to a second side of the weaving machine, the shuttle defining a guide recess therein, the guide recess extending along a longitudinal direction of the shuttle, the guide recess being open radially outwardly through a slot, the apparatus comprising:

a numbers of pin-shaped elements, each including a circular disc or sphere arranged one after another in a width direction of the weaving machine, said disc or sphere having a guiding, outer surface cooperating with an inner surface in the shuttle; and support members arranged on one end of the pin-shaped elements, wherein the shuttle runs on the support members as it moves from the first side to the second side, wherein the support members, as the shuttle passes, extend into the shuttle via the slot to guide the shuttle and wherein the support members have a substantially circular shape corresponding to a contour of the guide recess.

12. An acceleration apparatus for accelerating a shuttle in a weaving machine, the apparatus comprising:

an acceleration nozzle comprising:

a body having first and second ends, the body having an opening at the first end and defining therein a recess adapted to receive the shuttle, the opening communicating with the recess;

at least one first fluid passage extending longitudinally through the body, along the recess;

a plurality of outlet holes arranged one after another along the first fluid passage, the outlet holes providing a passage way from the first fluid passage to the recess; and a second fluid passage arranged at the second end of the body and communicating with the recess; and an air pressure source connected at the second end of the body via a connection member, the air pressure source providing air to the first and second fluid passages whereby air jets into the recess are generated.

13. The apparatus of claim 12 wherein the outlet holes are angled towards the first end.

14. The apparatus of claim 12 wherein the second fluid passage is arranged concentrically inside the body.

15. A shuttle comprising:

a body defining a guide recess therein, the guide recess extending in a longitudinal direction of the shuttle, the guide recess being open radially outward via a slot; and a number of fins arranged on the body.

16. The shuttle according to claim 15 wherein the body defines an opening at a rear end thereof, the opening communicating with the guide recess and the body further comprising a number of internal fins arranged in the guide recess.

17. The shuttle according to claim 15 wherein the fins are arranged one after the other along the body.

18. The shuttle according to claim 16 wherein the internal fins are arranged one after the other.

19. A combination according to claim 11 wherein the diameter of the guide recess exceeds the diameter of the members.

* * * * *